US011933571B2

(12) United States Patent
Robinson et al.

(10) Patent No.: US 11,933,571 B2
(45) Date of Patent: Mar. 19, 2024

(54) BUFFER SYSTEM FOR FIREARM

(71) Applicant: WHG PROPERTIES, LLC, North Wales, PA (US)

(72) Inventors: Frank Eric Robinson, Schwenksville, PA (US); William H. Geissele, Lower Gwynedd, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 17/812,890

(22) Filed: Jul. 15, 2022

(65) Prior Publication Data

US 2024/0019222 A1 Jan. 18, 2024

(51) Int. Cl.
*F41A 3/84* (2006.01)
*F41A 3/26* (2006.01)

(52) U.S. Cl.
CPC .. *F41A 3/84* (2013.01); *F41A 3/26* (2013.01)

(58) Field of Classification Search
CPC ..... F41A 3/56; F41A 3/78
See application file for complete search history.

(56) References Cited

U.S. PATENT DOCUMENTS 6,931,978 B1 * 8/2005 Dionne ..... F41A 3/12 89/194
10,704,854 B1 * 7/2020 Bender ..... F41A 19/16
11,215,412 B2 1/2022 Spangler et al.
2014/0041518 A1 2/2014 Neitzling
2016/0047612 A1 2/2016 Sullivan et al.
2016/0195360 A1 7/2016 Davies
2016/0370135 A1 * 12/2016 Plumb ..... F41A 3/90
2018/0266782 A1 * 9/2018 Bender ..... F41A 19/31
2019/0271515 A1 * 9/2019 Gibbens ..... F41A 15/14
2020/0240726 A1 7/2020 Spangler et al.

OTHER PUBLICATIONS

The Extended European Search Report for EP Patent Application No. 23171936.0 dated Nov. 22, 2023 (9 pages).

* cited by examiner

*Primary Examiner* — J. Woodrow Eldred
(74) *Attorney, Agent, or Firm* — Alston & Bird LLP

(57) ABSTRACT

Provided herein are buffer systems, bolt assemblies, firearms, and related methods, devices, and assemblies. A bolt carrier assembly for a firearm of an example includes: a bolt carrier body defining a cavity extending along a longitudinal axis of the bolt carrier; at least one weight disposed within the cavity; a forward stop at a forward end of the cavity; and an aft stop at an aft end of the cavity. In some embodiments, the bolt carrier assembly may include a spring, where the spring biases the at least one weight along the longitudinal axis toward at least one of the forward stop or the aft stop, where the at least one weight is configured to be driven against the spring bias in response to a firing action of the firearm.

25 Claims, 16 Drawing Sheets

BUFFER SYSTEM FOR FIREARM

TECHNOLOGICAL FIELD

Example embodiments relate generally to firearms, and, more particularly, to buffer systems configured to harness energy from the firing of a round to retract a bolt carrier group of the firearm, eject a spent cartridge, and chamber a new round in a fluid manner.

BACKGROUND

Tactical rifles and other types of firearms may be equipped with a barrel and bolt that, in conjunction, hold or support a cartridge during operation of the firearm (e.g., with a chamber). A magazine contains the cartridges that are fed from the magazine to the chamber during operational cycles. Actuation of the operational cycle of the firearm may be performed manually by an operator (e.g., bolt action rifles) or by way of an autoloading action (e.g., automatic or semi-automatic rifles), such as a high-pressure propellant gas.

The firearm may integrate the barrel into a barrel assembly (e.g., with or without a barrel extension) which may include one or more lugs that engage corresponding lugs of the firearm's bolt. Following firing of the cartridge, a bolt carrier is driven backwards within an upper receiver of the firearm against a bias from a buffer spring or mainspring into a barrel extension or buffer tube. An extractor attached to the bolt carrier may operate to, via engagement with the cartridge casing, pull the spent casing from the chamber for further expulsion from the firearm by an ejector. The bolt carrier is driven back toward the barrel once the buffer spring overcomes the forces generated by the gas system and chambers a new round. This action happens relatively quickly and can involve sharp changes in acceleration that can result in movement of the firearm, which may result in lower accuracy and/or poorer feeding for subsequent or sequential rounds. Embodiments described herein smooth the action of the bolt carrier within the firearm to provide more accurate and repeatable aim while rendering the firearm easier and more comfortable to operate.

BRIEF SUMMARY

The present disclosure relates generally to firearms, and, more particularly, to buffer systems configured to harness energy from the firing of a round to retract a bolt carrier group of the firearm, eject a spent cartridge, and chamber a new round in a fluid manner.

According to some aspects of the present disclosure, a bolt carrier assembly for a firearm is provided including: a bolt carrier body defining a cavity extending along a longitudinal axis of the bolt carrier; at least one weight disposed within the cavity; a forward stop at a forward end of the cavity; and an aft stop at an aft end of the cavity. In some embodiments the bolt carrier may include a spring, where the spring biases the at least one weight along the longitudinal axis toward at least one of the forward stop or the aft stop, and where the at least one weight is configured to be driven against the spring bias in response to a firing action of the firearm. The aft stop of an example embodiment includes a plug, such as a threaded plug or a plug otherwise received at least partially within a bore of the bolt carrier body. The spring of an example embodiment is disposed between the plug and the at least one weight and biases the at least one weight into contact with the forward stop. A threaded plug of an example embodiment is received into mating threads of the bore of the bolt carrier body. In some embodiments, the at least one weight is only biased in one direction along the longitudinal axis toward the one of the forward stop or the aft stop. The at least one weight may be disposed entirely forward of an aft-most side of the bolt carrier body. In some embodiments, a length of the bolt carrier body corresponds to a TDP length for the firearm. In some embodiments, a portion of the at least one weight extends forward past the forward stop.

According to some embodiments, the at least one weight includes one or more weights disposed within a carrier, where the carrier includes one or more resilient spacers spacing the carrier away from a wall of the cavity. The one or more resilient spacers include, in some embodiments, a polymer material. The one or more weights include, in some embodiments, a pill-shaped weight within a corresponding cavity of the carrier. The one or more weights of some embodiments include two ball-shaped weights within corresponding cavities of the carrier. The forward stop of an example embodiment includes a step within a bore of the bolt carrier body. The forward stop of an example embodiment includes a pin within a bore of the bolt carrier body.

Embodiments provided herein include a firearm including: a barrel assembly including a barrel or a barrel extension defining one or more locking lugs; an upper receiver attached to the barrel assembly; a bolt carrier within the upper receiver, where the bolt carrier defines a cavity therein extending along a longitudinal axis of the bolt carrier, the bolt carrier including a bolt engaging the one or more locking lugs of the barrel assembly; at least one weight disposed within the cavity; a forward stop at a forward end of the cavity; and an aft stop at an aft end of the cavity. In some embodiments, the firearm may include a spring, where the spring biases the at least one weight along the longitudinal axis toward one of the forward stop or the aft stop. In some embodiments, the firearm may include a second weight disposed outside the bolt carrier within a buffer tube of the firearm. In some embodiments, the at least one weight may be the only buffer weight used in the firearm. In some embodiments, the bolt carrier further defines a flange configured to engage a buffer spring, wherein the buffer spring is disposed in a buffer tube of the firearm.

According to certain embodiments, in response to a firing action of the firearm, the bolt carrier is configured to be driven away from the barrel assembly, and the at least one weight disposed within the cavity is configured to be driven along the longitudinal axis against the spring bias in response to the firing action of the firearm. According to some embodiments, the spring is disposed between the forward stop and the at least one weight, where the spring biases the at least one weight along the longitudinal axis toward the aft stop. The spring of an example embodiment is disposed between the aft stop and the at least one weight, where the spring biases the at least one weight along the longitudinal axis toward the forward stop. The aft stop of an example embodiment includes a threaded plug received into mating threads of the bore of the bolt carrier. The at least one weight includes, in some embodiments, one or more weights disposed within a carrier, where the carrier includes one or more resilient spacers spacing the carrier from a wall of the cavity.

Embodiments provided herein include a weight assembly within a firearm including: at least one weight disposed within a cavity; a forward stop within the cavity; and an aft stop within the cavity. In some embodiments, the firearm may include a spring biasing the at least one weight toward one of the forward stop or the aft stop, where the at least one weight moves within the cavity between the forward stop and the aft stop in response to a firing action of the firearm. The at least one weight includes, in some embodiments, one or more weights within a carrier, where the carrier includes one or more spacers to space the carrier from a wall of the cavity. The weight assembly of an example embodiment is encompassed within a bolt carrier of the firearm.

A variety of additional aspects are also described in the following detailed description and in the attached claims. The aspects can relate to individual features and to combinations of features. It is to be understood that both the foregoing general description and the following detailed description are exemplary and explanatory only and are not restrictive of the broader inventive concepts upon which the example embodiments disclosed herein are based.

BRIEF DESCRIPTION OF THE DRAWINGS

Having thus described embodiments of the disclosure in general terms, reference will now be made to the accompanying drawings, which are not necessarily drawn to scale. The following drawings are illustrative of particular embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
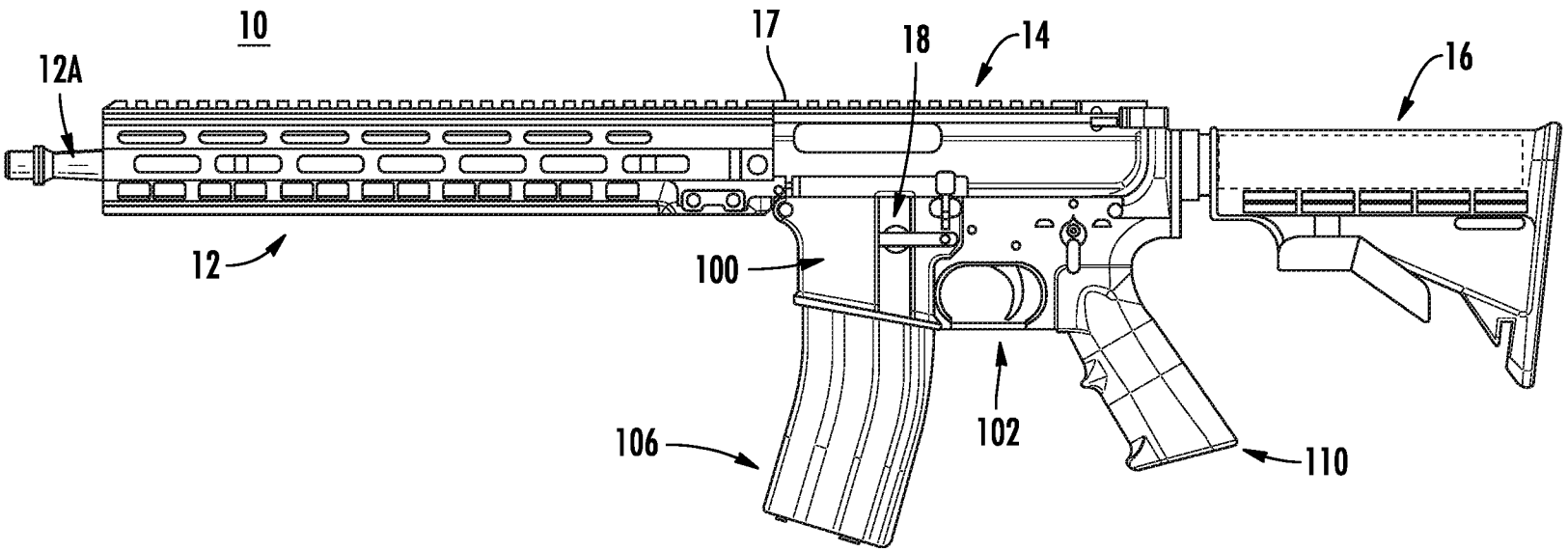
Figure 2:
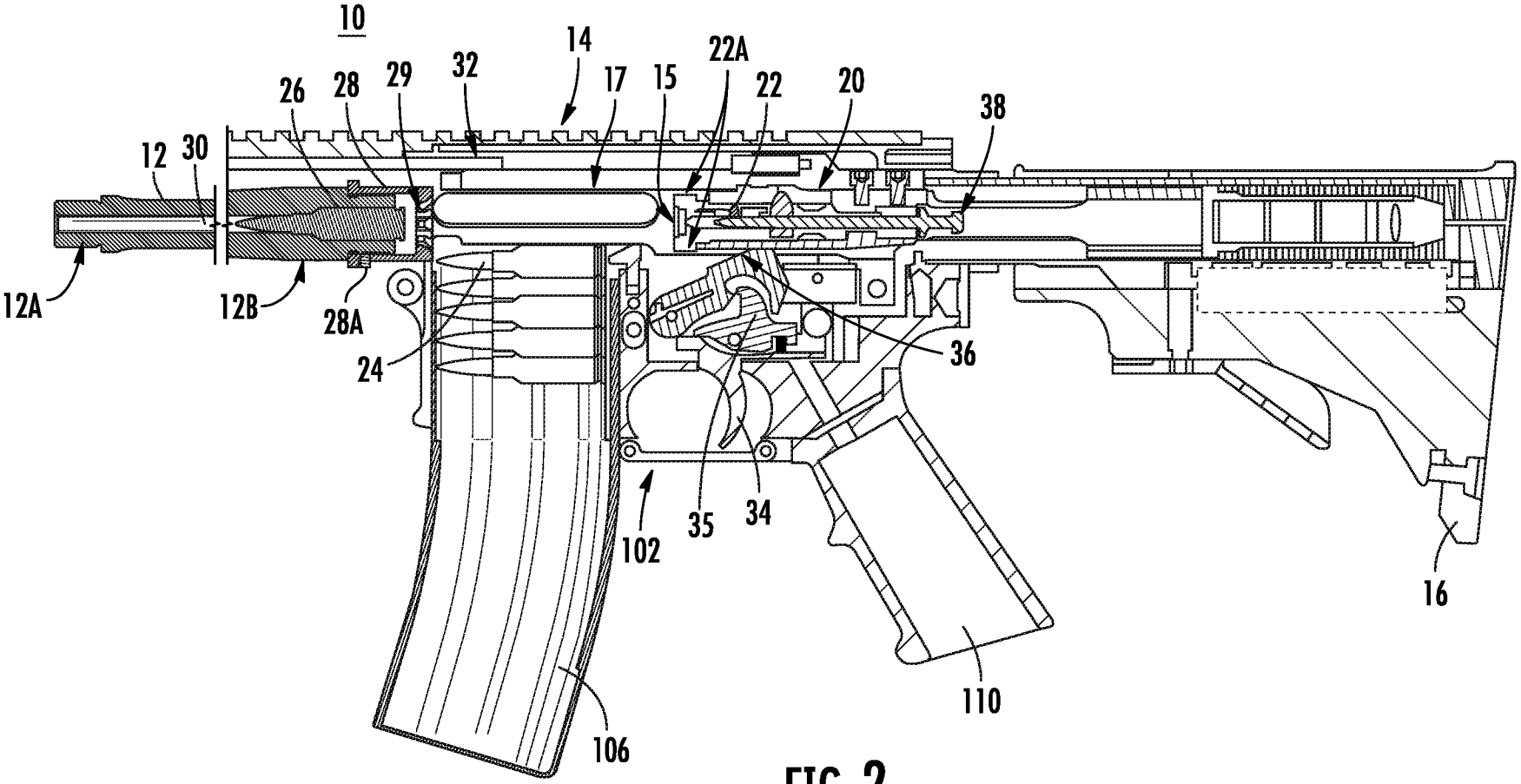
Figure 3:
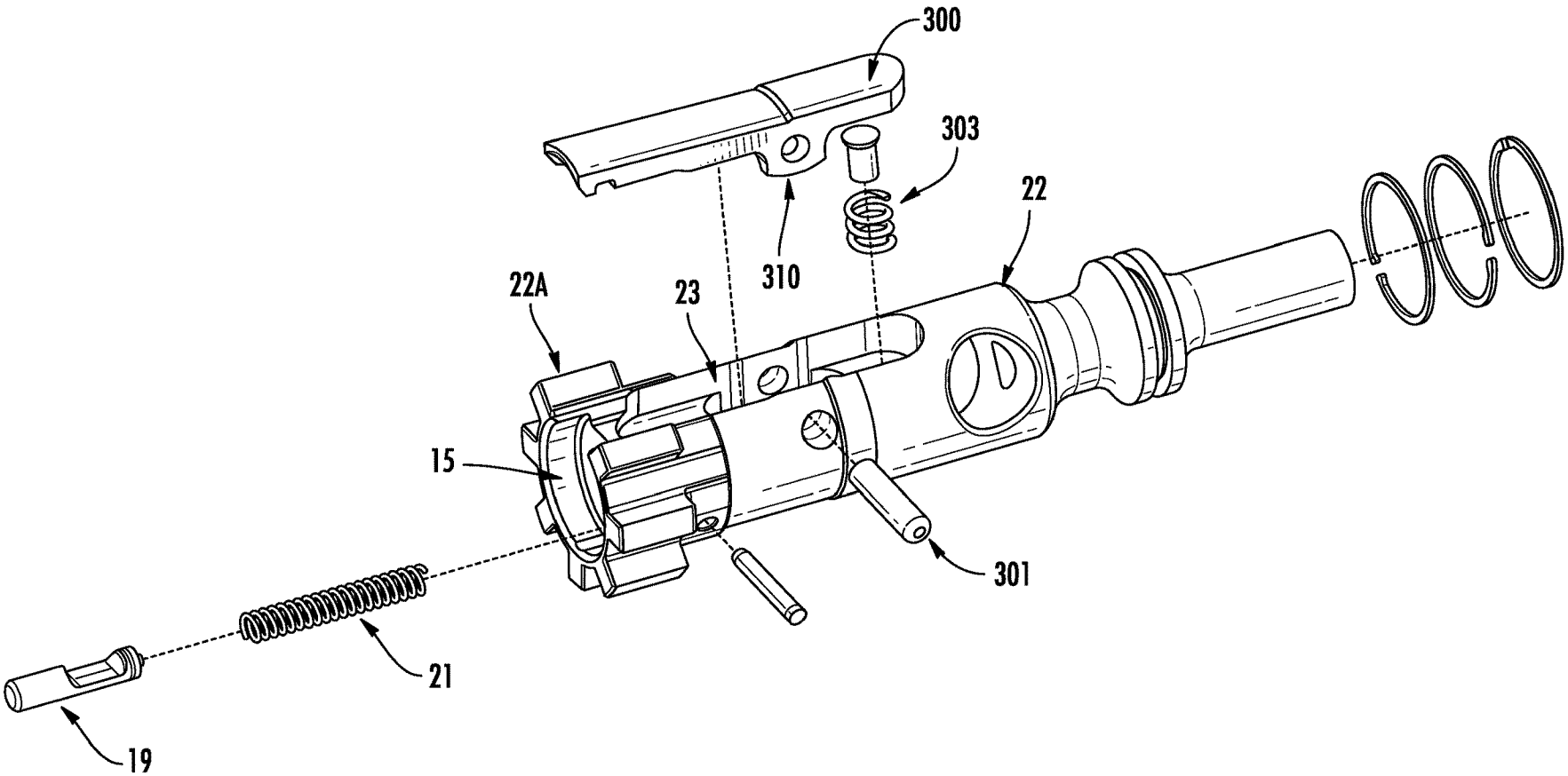
Figure 4:
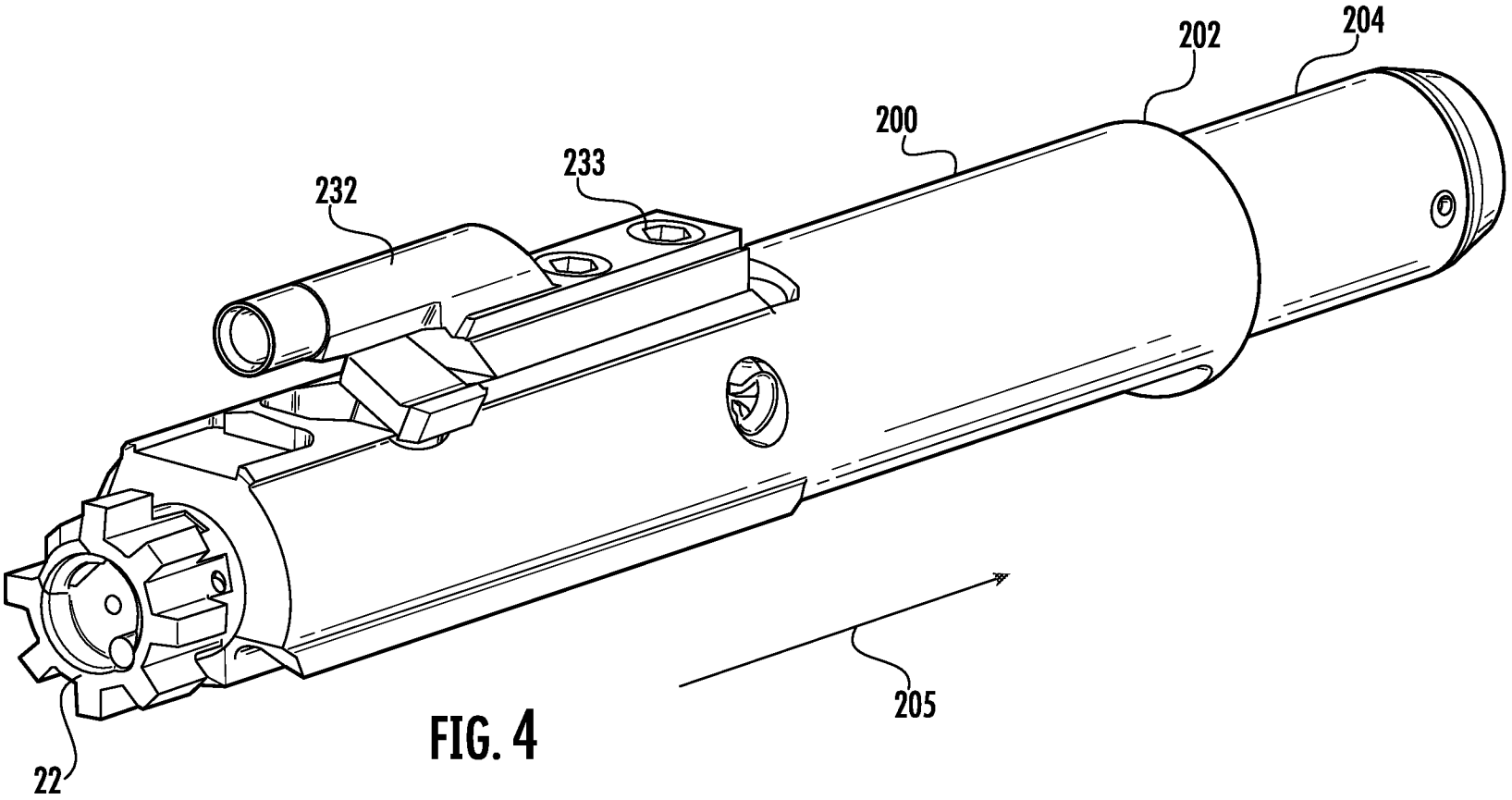
Figure 5:
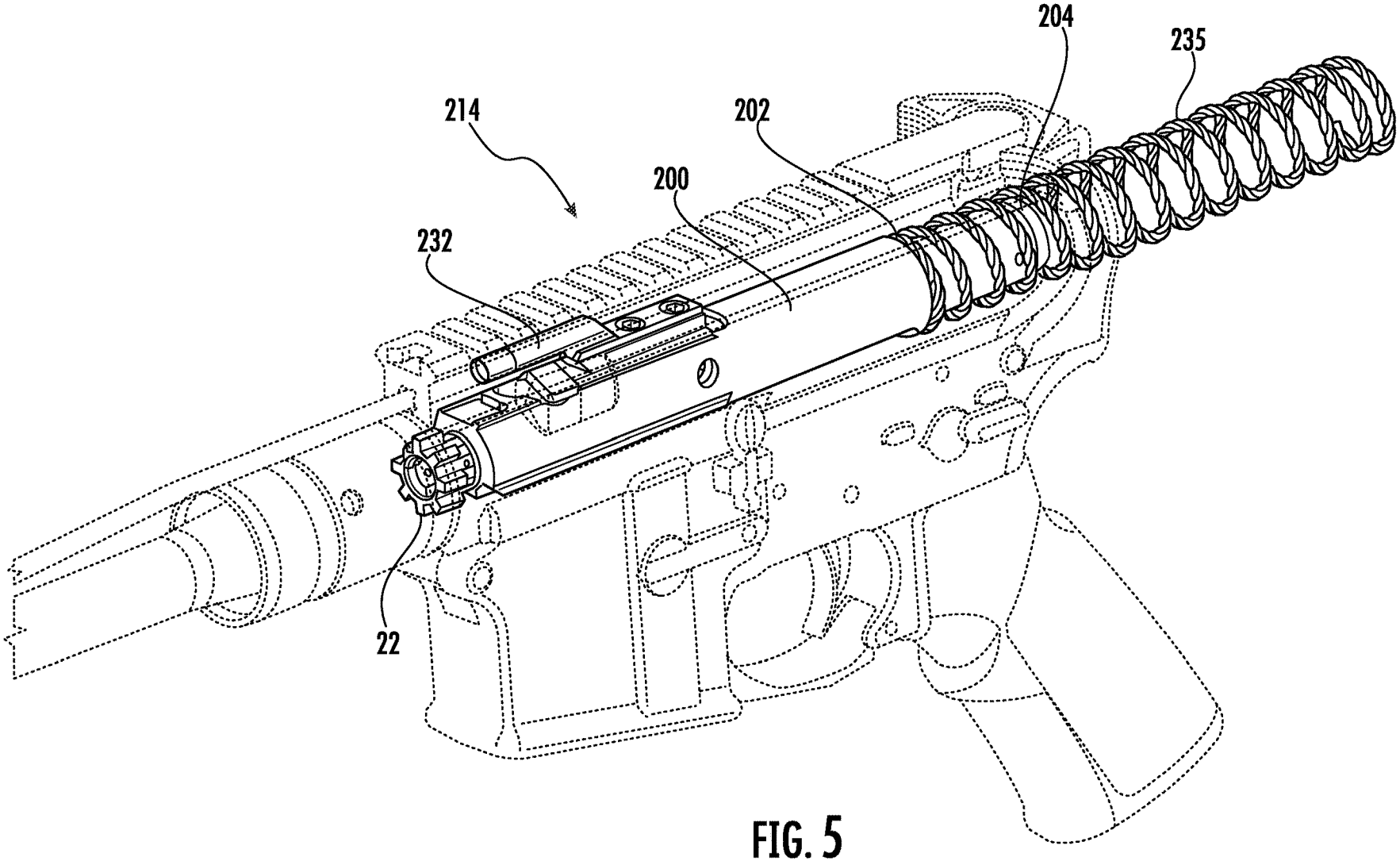
Figure 6:
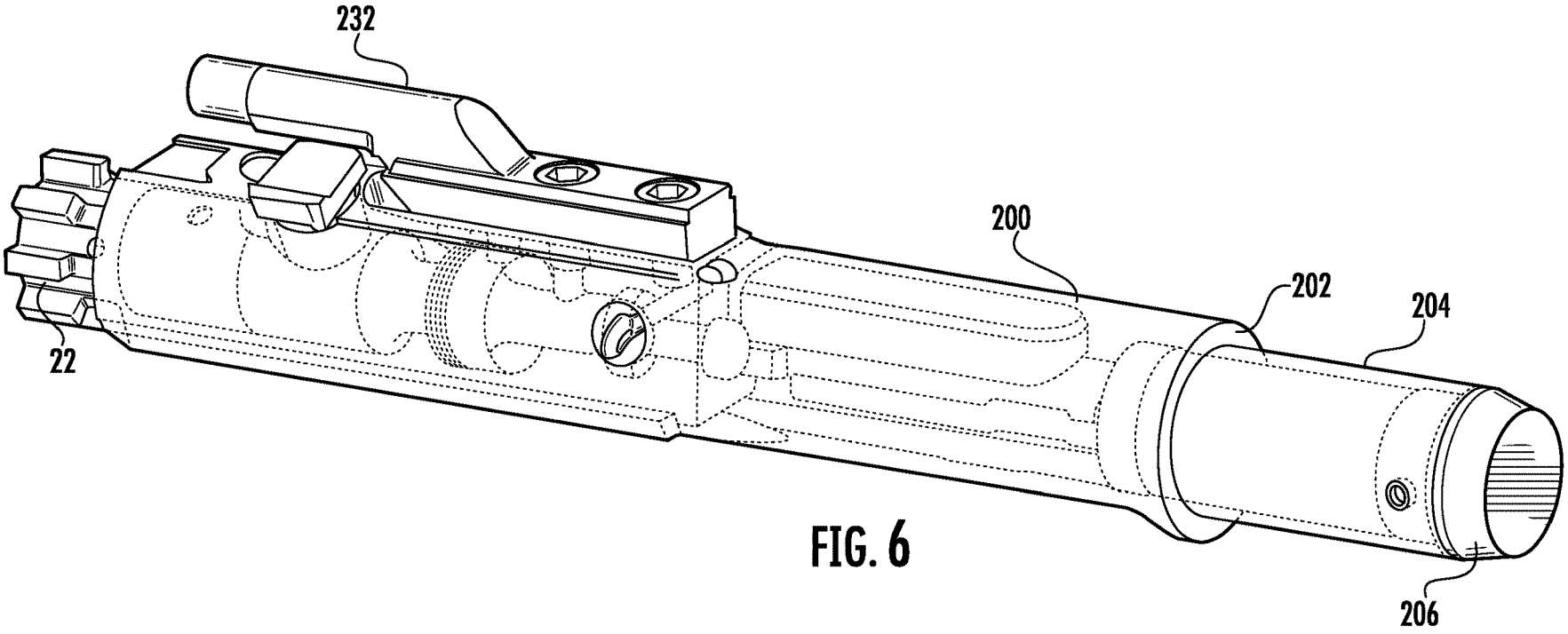
Figure 7:
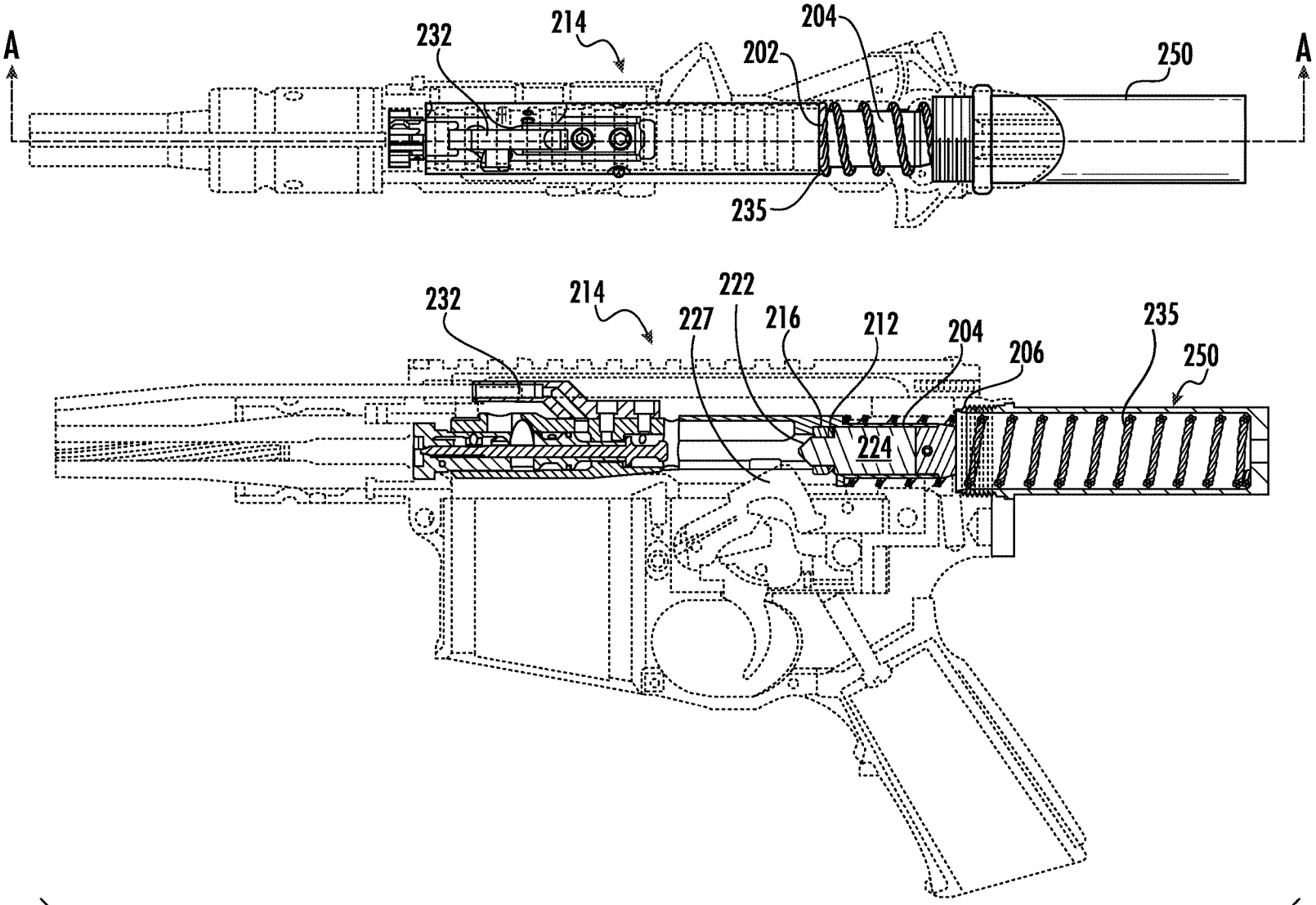
Figure 8:
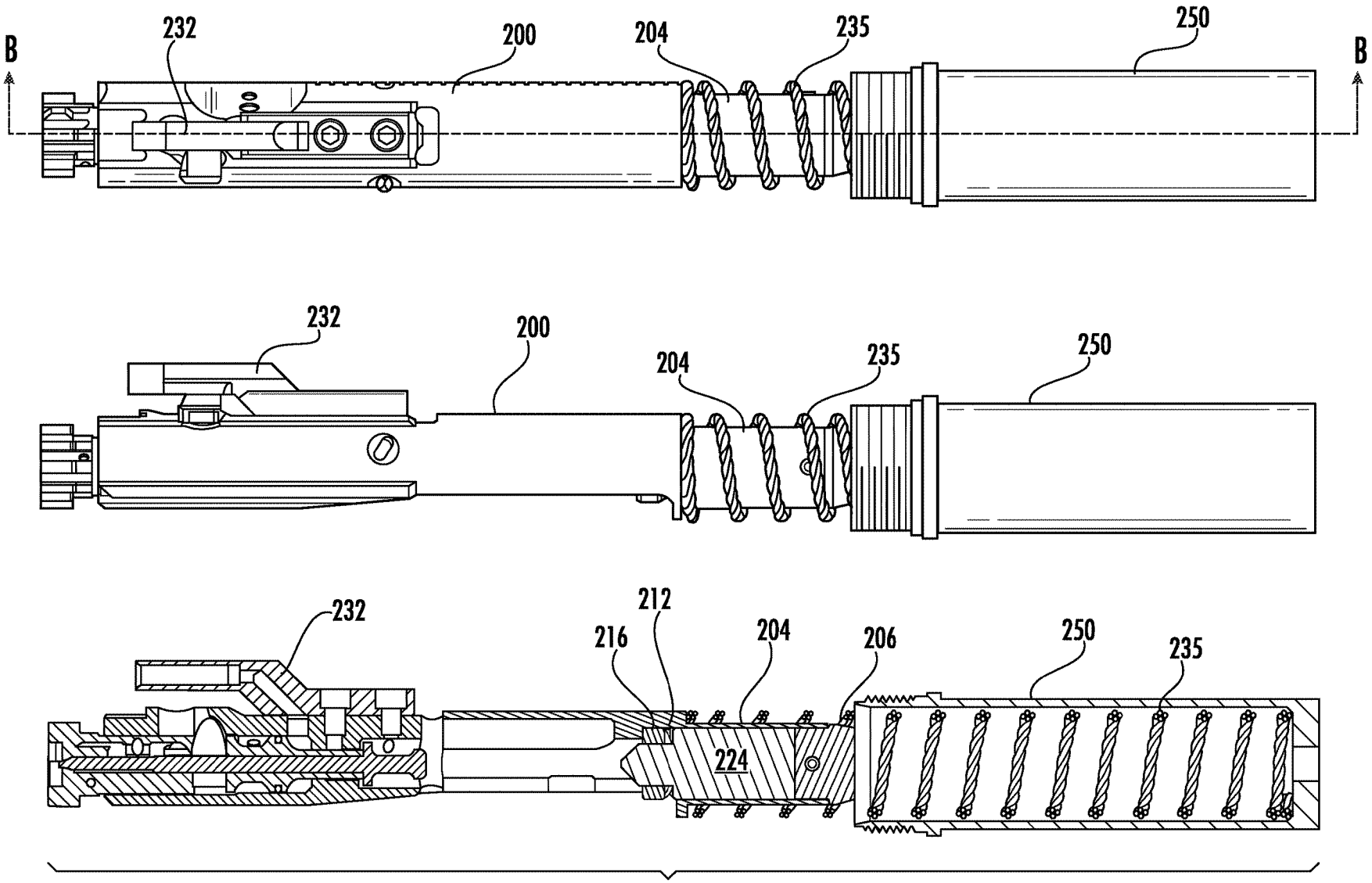
Figure 9:
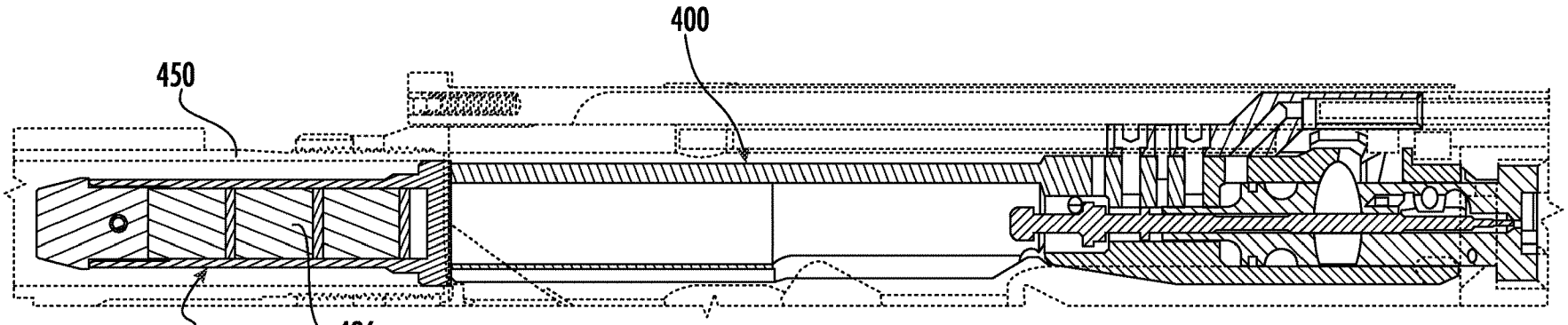
Figure 10:
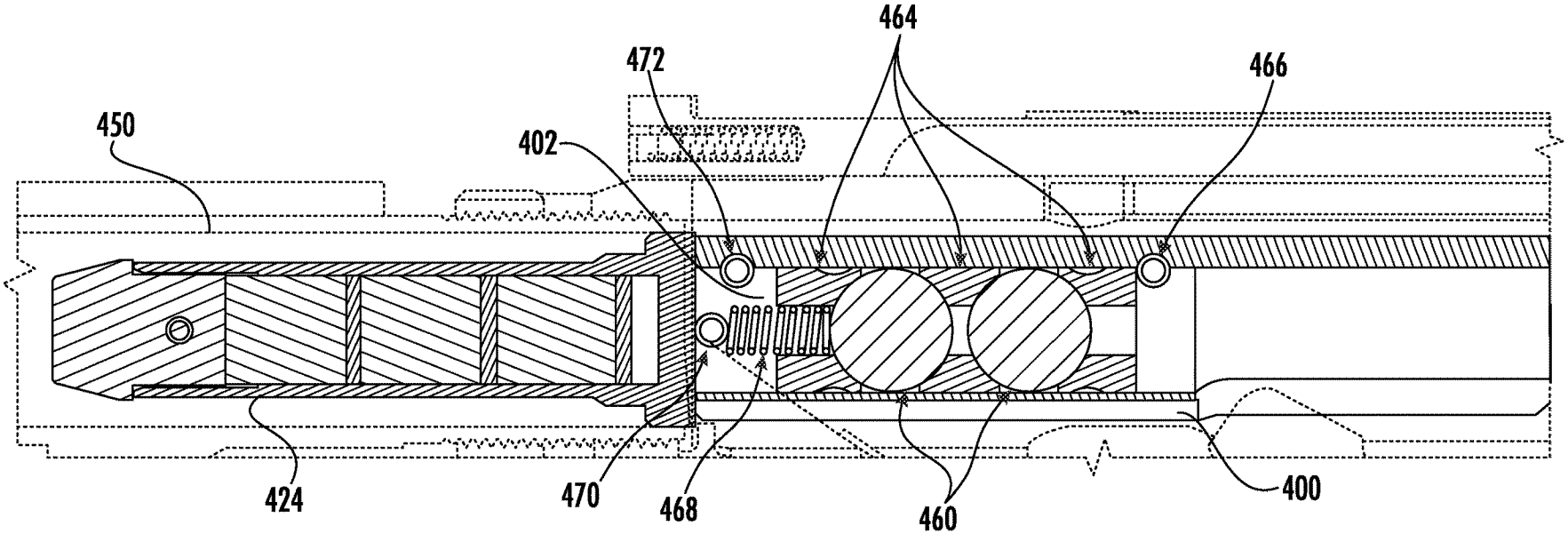
Figure 11:
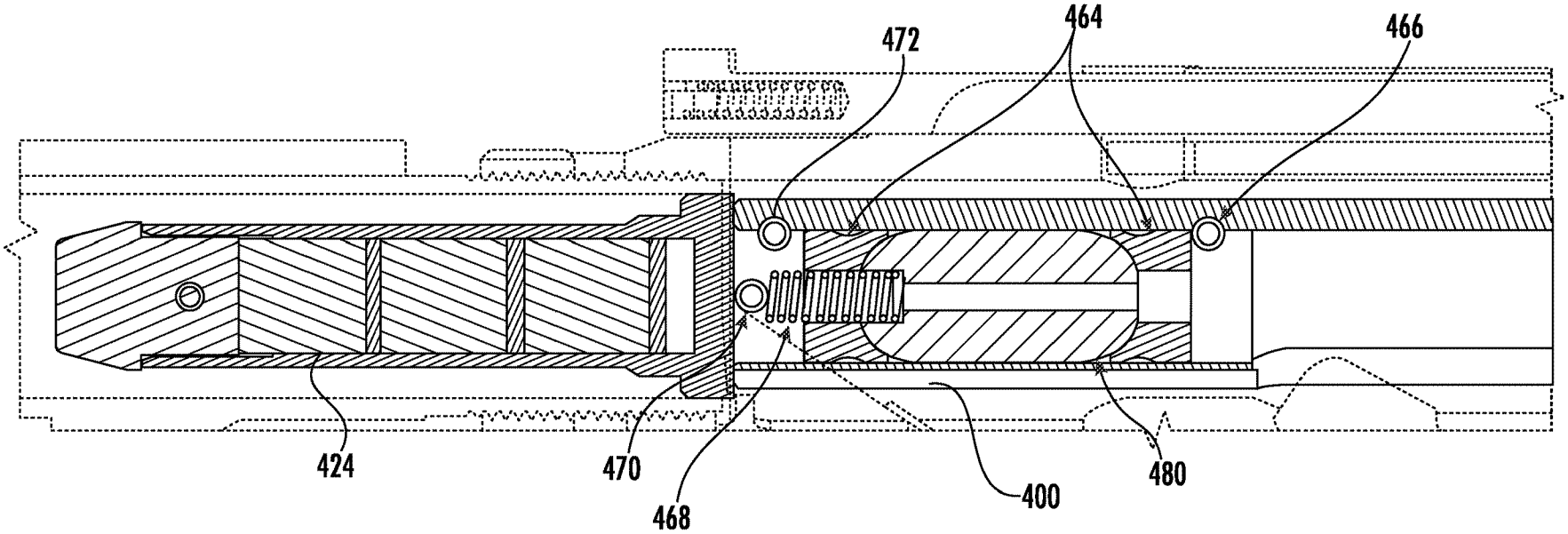
Figure 12:
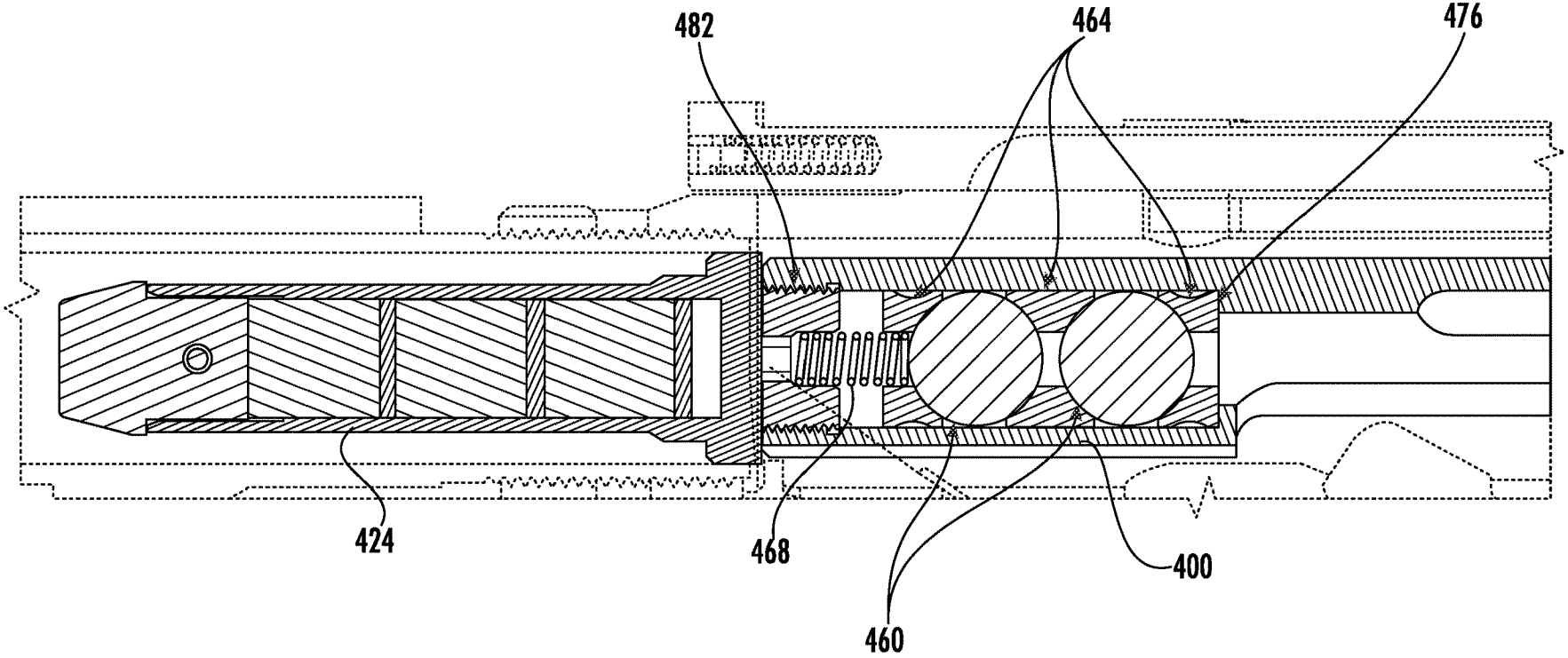
Figure 13:
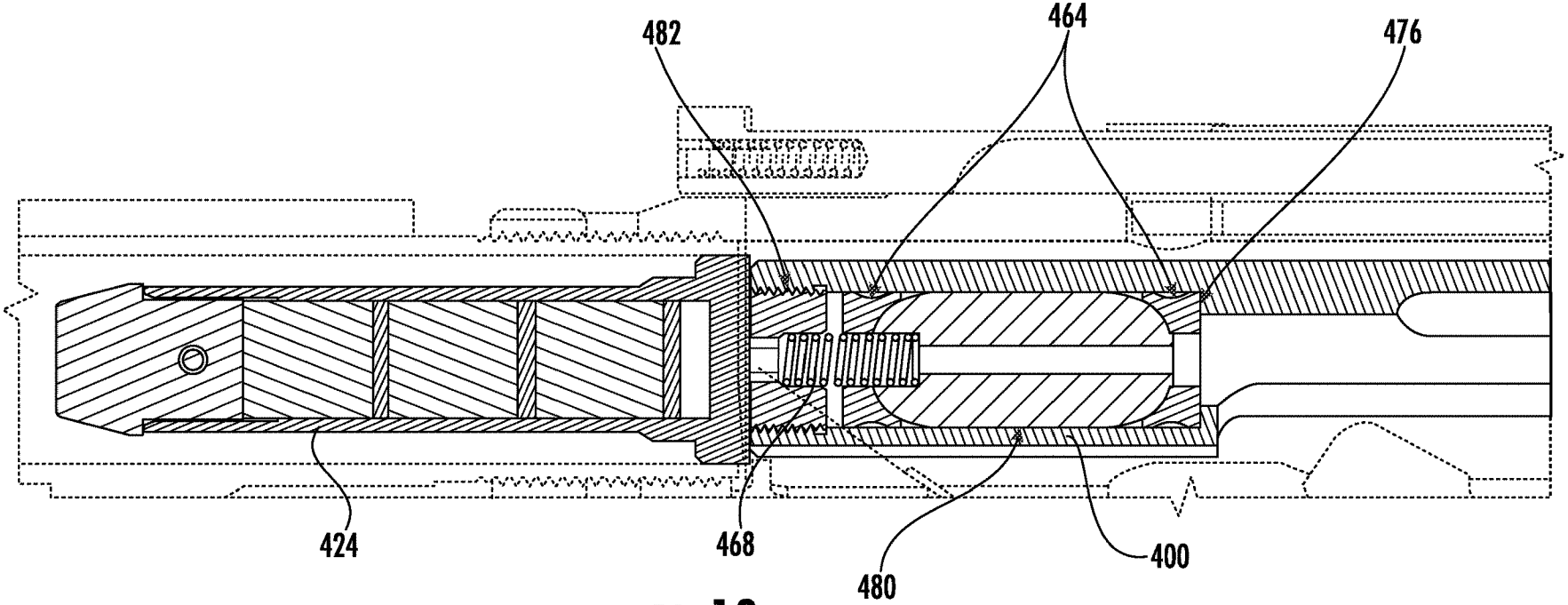
Figure 14:
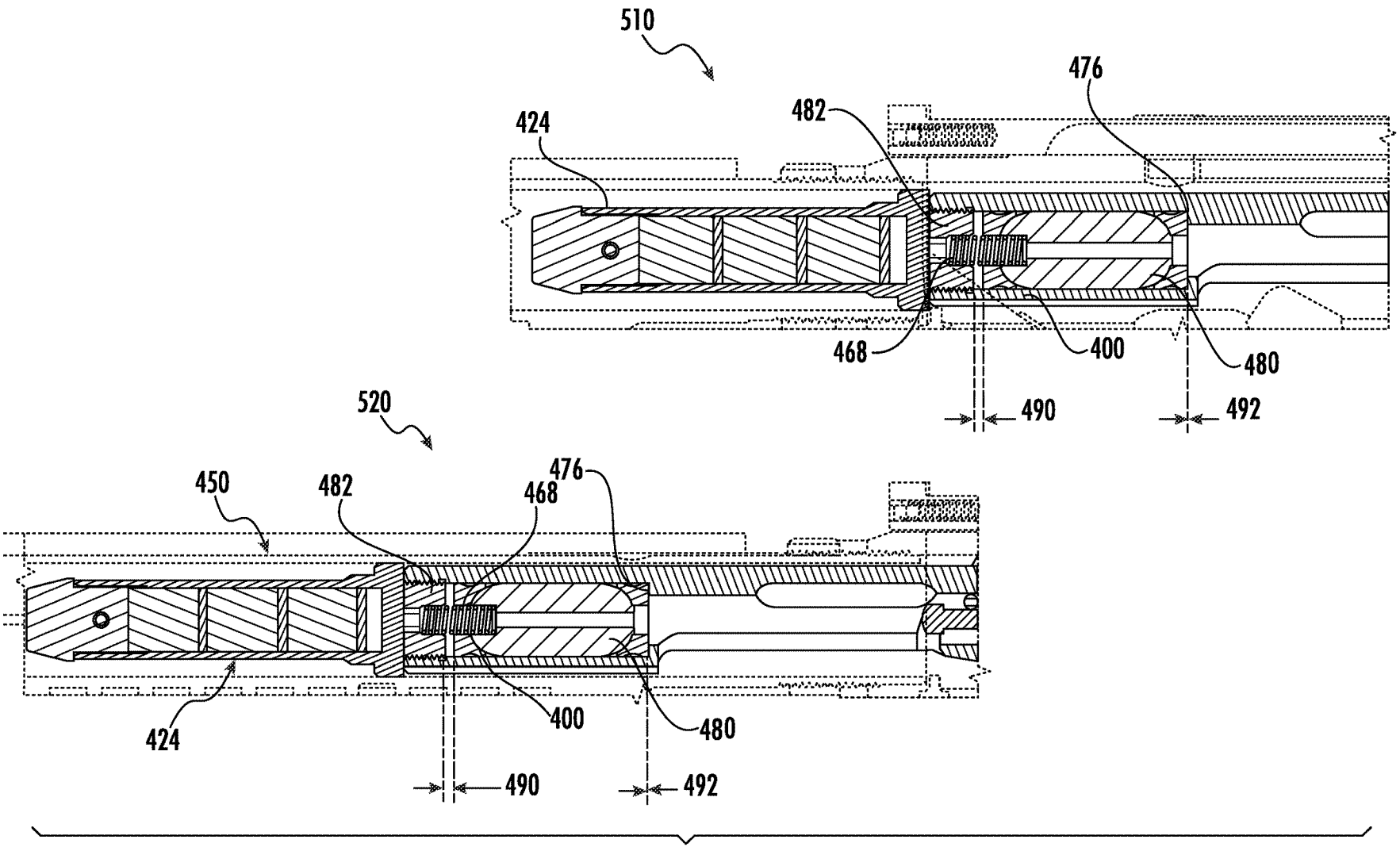
Figure 15:
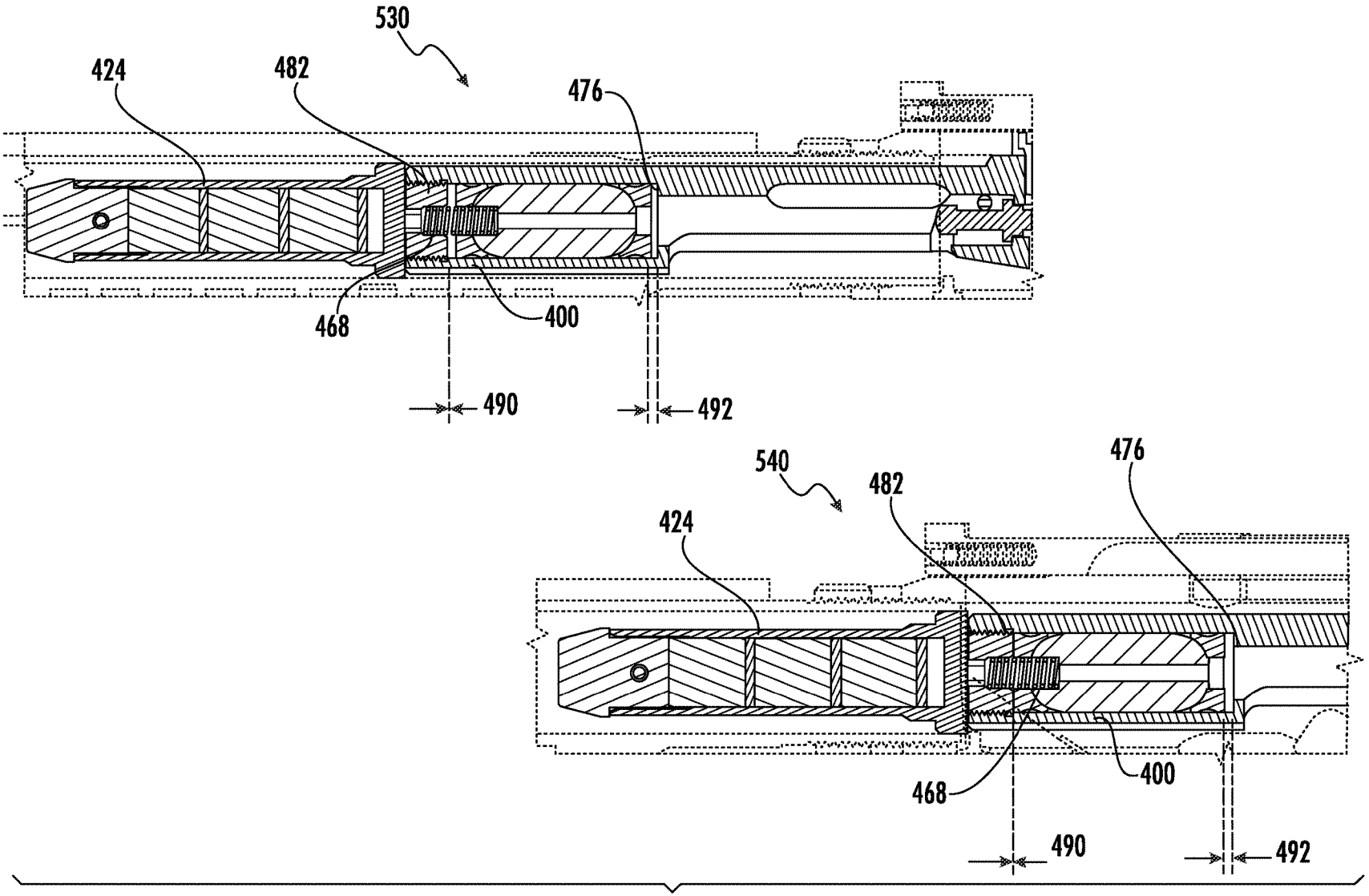
Figure 16:
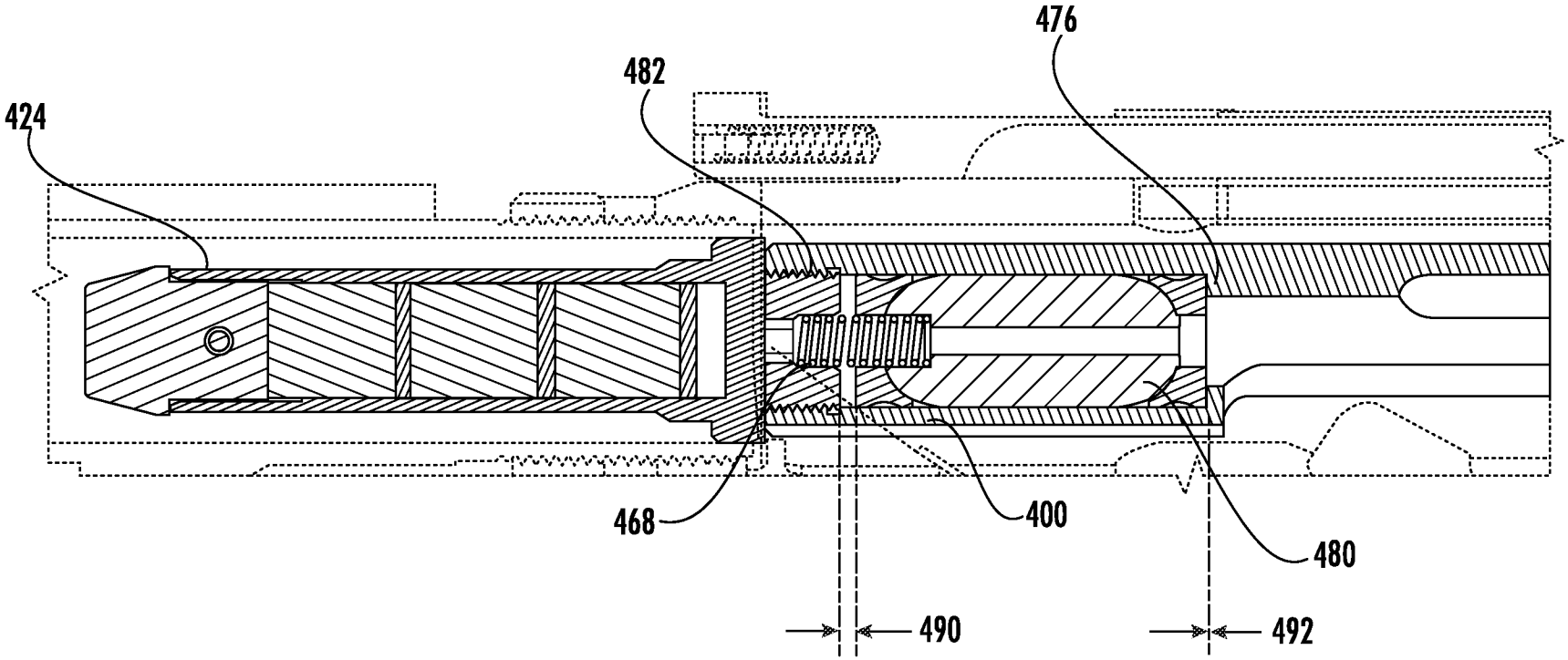

FIG. 1 illustrates a side view of a firearm according to an example embodiment of the present disclosure;

FIG. 2 illustrates a cross-sectional view of a portion of the firearm of FIG. 1 according to an example embodiment of the present disclosure;

FIG. 3 illustrates a partially exploded view of a portion of an example bolt assembly according to an example embodiment of the present disclosure;

FIG. 4 illustrates a bolt carrier of a bolt carrier group that engages the bolt according to an example embodiment of the present disclosure;

FIG. 5 illustrates a cut-away view of a bolt carrier within the upper receiver and a buffer spring that biases the bolt carrier toward the barrel, opposite the forces of the gas delivery system according to an example embodiment of the present disclosure;

FIG. 6 illustrates the bolt carrier of FIG. 4 from a different view including the buffer weight housing and flange according to an example embodiment of the present disclosure;

FIG. 7 illustrates a top view of an upper receiver cutaway view and a section view of a side of the upper receiver taken along section line A-A of the top view according to an example embodiment of the present disclosure;

FIG. 8 illustrates the bolt carrier group including the bolt carrier without the upper receiver for ease of understanding according to an example embodiment of the present disclosure;

FIG. 9 illustrates a conventional bolt carrier group of a firearm including a bolt carrier and gas key similar to those described with respect to FIG. 2 according to an example embodiment of the present disclosure;

FIG. 10 illustrates an example embodiment in which a sliding weight is provided within a cavity of the bolt carrier in the form of two rolling balls according to an example embodiment of the present disclosure;

FIG. 11 illustrates another example of the sliding weight mechanism according to an example embodiment of the present disclosure;

FIG. 12 illustrates another example of the sliding weight mechanism according to an example embodiment of the present disclosure;

FIG. 13 illustrates another example of the sliding weight mechanism according to an example embodiment of the present disclosure;

FIG. 14 illustrates two positions of the bolt carrier and sliding weight mechanism during operation of a firearm according to an example embodiment of the present disclosure;

FIG. 15 illustrates two further positions of the bolt carrier and sliding weight mechanism during operation of a firearm according to an example embodiment of the present disclosure; and FIG. 16 illustrates the final rest position of the bolt carrier and sliding weight mechanism after a firing action of the firearm according to an example embodiment of the present disclosure.

DETAILED DESCRIPTION

Some embodiments of the present invention will now be described more fully hereinafter with reference to the accompanying drawings, in which some, but not all, embodiments of the invention are shown. Like reference numerals refer to like elements throughout. Indeed, various embodiments of the invention may be embodied in many different forms and should not be construed as limited to the embodiments set forth herein. Rather, these embodiments are provided so that this disclosure will satisfy applicable legal requirements.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Thus, use of any such aforementioned terms, or similarly interchangeable terms, should not be taken to limit the spirit and scope of embodiments of the present invention.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

According to embodiments described herein, a chambered round in a firearm (e.g., an AR-15 platform rifle or pistol or another autoloading firearm) is fired in a firing action in which a trigger assembly causes the round to discharge and propel a projectile down the barrel with expanding gas. Following the firing action of the firearm, a gas delivery system or other autoloading system may force the bolt carrier group rearward causing rotation of a bolt of the bolt carrier group about its longitudinal axis and axial disconnection of lugs of the bolt from locking lugs of the barrel or barrel extension. The bolt carrier group is retracted rearward in a cycling action. During this movement, an ejector may apply a force to the cartridge parallel to and offset from the longitudinal axis of the bolt and cartridge to cause the spent cartridge casing to pivot about a notch in the extractor and eject from the firearm via an ejection port once the cartridge clears the lugs of the barrel or barrel extension. The ejector may be offset from the center of mass of the cartridge casing to cause the casing to rotate towards the firearm's ejection port. The extractor may further include an extractor spring configured to impart a force on the extractor body opposite the end of the extractor that engages the cartridge casing that, due to the pivotal engagement between the extractor and the bolt, urges the end of the extractor into engagement with the cartridge casing and further facilitates ejecting of the cartridge casing (e.g., once the spent cartridge casing has cleared the barrel or barrel extension as the bolt moves rearward).

The movement of the bolt carrier group to the retracted state further enables a new round to be driven from the magazine to the chamber. The bolt carrier group is biased back toward the barrel by a spring to close the bolt and chamber the new round ready for firing. The spring that biases the bolt carrier group back to the engaged position is used in conjunction with a weight to form the buffer. The spring or buffer spring and the weight or buffer weight form the buffer system.

The manner by which a buffer system counters movement of the bolt carrier group can adversely affect the operation of a firearm when the action is not smooth. The forces involved in the firing of a round from a firearm can cause movement of the firearm and displacement of the barrel from a firing line with a target. Semi-automatic and fully-automatic retraction of a bolt carrier group, ejection of a casing of a spent round, chambering of a new round, and re-engagement of the bolt carrier group can cause sharp acceleration movements of a firearm if the action is not adequately buffered. In some instances, the bolt may bounce or otherwise not securely lock with the lugs and jam the action if the bolt closes too quickly or harshly. Buffer systems according to various embodiments disclosed herein serve to smooth the action and decrease sharp acceleration movements for a more fluid action with predictable and repeatable forces. Smoothing the action enables a marksman to better maintain the barrel of the firearm in proper aim with the target during firing of sequential rounds and ensures a more consistent and reliable cycling. Embodiments described herein may provide a mechanism through which the action is smoothed through an improved buffer system to improve operation and accuracy of a firearm.

In some instances, the buffer system may require substantial space to operate, which may negatively affect the size of the firearm by requiring a long buttstock with a long buffer tube to accommodate the buffer system. Embodiments described herein may additionally or alternatively provide a more compact buffer system that may facilitate shortening of the firearm relative to standard buffer system weapons.

The present disclosure relates to buffer systems for use with firearms, bolt assemblies, and related components, that provide improved automatic or semi-automatic functioning of a firearm to fluidically harness the gas from a fired round to eject the casing of the spent round and load a new round into the chamber.

With reference to FIG. 1, a firearm 10 is illustrated depicting relevant components. The firearm 10 of the illustrated embodiment includes a barrel 12, an upper receiver 14, a lower receiver assembly 100; a magazine 106, a grip 110, a trigger guard 102, an action, including a bolt carrier group (e.g., bolt carrier, bolt, firing pin, ejector, etc.) (shown in FIGS. 2-3), an autoloading system (e.g., gas driven system (gas direct gas impingement, gas piston, etc.), recoil-driven autoloader, inertia-driven autoloader, etc.) (not shown), buttstock 16, magazine catch 18, ejection port 17, and/or other firearm components that would be appreciated in light of the present disclosure. In some embodiments, the firearm may be an AR-15 platform weapon configured to fire any of the cartridges disclosed herein or known in the art. In some embodiments, the firearm may be an AR-15 platform weapon configured to fire a cartridge casing of a 6.5 mm Grendel, 6 mm ARC, 6 mm Remington®, 6.8 mm Remington® SPC, 6.5 mm Creedmoor, 0.224 Valkyrie, 7.62×39, 0.458 SOCOM, 0.50 Beowulf, 0.450 Bushmaster, and/or the like. In some embodiments, the firearm may be another similar weapon, such as variants of the SR-25, AR-10, M4, M16, or the like firearm platforms. The buffer system described herein can be tuned according to the cartridge(s) to be used in the firearm. Different buffer weights and/or different buffer springs can be used to obtain the desired buffer system response as described herein.

With reference to FIG. 2, according to some embodiments, a magazine 106 may be held in a magazine well 112 defined by a lower receiver of the firearm. The magazines 106 and the magazine well 112 may include a clearance that may allow the magazine to drop free when released while also holding the magazine 106 in a stable position. This stable positioning may allow a cartridge 24 to be stripped from the top of the magazine 106 by a bolt 22 and fed forward and upward into the chamber 26 of the barrel 12 as the firearm cycles. The bolt 22 may then lock with a barrel extension 28 to hold the cartridge 24 in place. The bolt lugs 22A interface with the locking lugs 29 of barrel extension 28 to lock the bolt 22, for example, by inserting the bolt lugs 22A between the barrel extension locking lugs 29 and rotating the bolt 22 about its longitudinal axis to align the rear of the bolt lugs 22A with the inner, forward surface of the barrel extension locking lugs 29. The locking lugs 29 of the barrel extension 28 (or as defined by the barrel 12 in other embodiments) may define an associated clearance as the distance between the innermost surface of the locking lugs 29 to the center axis of the bolt 22 and/or barrel extension 28. The inner surface 30 of the barrel 12 at the chamber 26 may support the cartridge casing during ignition of the cartridge propellent, preventing the cartridge casing from deforming, splitting, or otherwise misfiring during the increase in internal pressure and facilitating direction of the expanding gases behind the bullet to propel the bullet down the bore of the barrel.

Although described herein with reference to a barrel 12 that engages a barrel extension 28, the present disclosure contemplates that, in some embodiments, the barrel 12 may instead include locking lugs 29 (e.g., without a barrel extension 28). In such an embodiment, the bolt lugs 22A may interface with the locking lugs 29 defined by the barrel 12 to lock the bolt 22. Similar to the barrel extension 28, this locking action may occur by inserting the bolt lugs 22A between the locking lugs 29 of the barrel 12 and rotating the bolt 22 to align the rear of the bolt lugs 22A with the inner, forward surface of the locking lugs 29 of the barrel 12. Said differently, the extractor embodiments described herein may be applicable for use with firearms that include a barrel and associated barrel extension as well as firearms that rely upon a barrel alone (e.g., without a barrel extension), such as an M14.

With continued reference to FIG. 2, a cross-section of a portion of the firearm 10 is shown. In various embodiments, the barrel 12 includes a muzzle end 12A and a chamber end 12B that may attach to a barrel extension 28 attached to the upper receiver 14. The barrel extension 28 and the chamber end 12B of the barrel 12 may be connected via barrel interface surfaces 28B (e.g., threading or the like). In some embodiments, the outer surface of the barrel 12 and inner surface of the barrel extension 28 may have complementary surfaces, such as threading, for engaging the components. The barrel 12 and barrel extension 28 may be held together by a fastener 28A (e.g., a set screw or the like.).

The depicted firearm 10 is further shown with a bolt carrier group 20 and a bolt 22 (e.g., described further with reference to FIG. 3) configured to strip a cartridge 24 from the magazine 106 and feed the cartridge into the chamber 26 of the chamber end 12B of the barrel 12 for firing. The cartridge 24 may be retained in the chamber 26 by a taper in the inner surface 30 of the barrel 12 at the front end and by the bolt 22 at the rear end (e.g., via engagement between the cartridge 24 and a corresponding recess 15 defined by the bolt), with the chamber 26 providing support for the casing. Firing of cartridge 24 occurs during actuation of trigger 34 while the bolt carrier group 20 is in the forward position (e.g., toward the left of FIG. 2), and the bolt lugs 22A are engaged with the barrel extension lugs 29. Actuation of trigger 34 causes disconnector 35 to release hammer 36. The firing pin 38 is driven toward the primer of cartridge 24 when the firing pin 38 is struck by hammer 36, thus firing the chambered cartridge 24. Gas delivery system 32 directs at least some of the expanding gases generated by firing the chambered cartridge 24 from a location at or near the muzzle end to at least force the bolt carrier group 20 rearward (e.g., toward the right of FIG. 2) causing disconnection of the lugs, extraction of the spent cartridge casing from chamber 26, ejection of the spent cartridge from the chamber 26 via the ejection port 17, and resetting the trigger assembly components (e.g., hammer 36, disconnector 35, trigger 34, and other trigger components known in the art).

With reference to FIG. 3, an exploded view of a bolt assembly including the bolt 22 and extractor 300 is illustrated. As shown, the bolt 22 may define bolt lugs 22A as described above that interface with the locking lugs 29 of barrel extension 28 (shown in FIG. 2) to lock the bolt 22. The bolt 22 may also define a groove 23 (e.g., slot, channel, recess, etc.) configured to receive the extractor 300 therein. In order to pivotally attach the extractor 300 to the bolt 22, the bolt 22 may employ an extractor pin 301 that engages with a pivot portion 310 of the extractor 300. This pivotal engagement between the extractor 300 and the bolt 22 via the extractor pin 301 may operate to allow the extractor 300 to pivot about the pivot portion of the extractor 300 such that the extractor 300 may engage/disengage and guide a cartridge casing as described above. Following a firing action by the firearm 10, a gas delivery system 32 may force the bolt carrier group 20 rearward causing rotation of the bolt 22 and disconnection of the lugs 22A from the locking lugs 29. During this movement, an ejector 19 may input axial force (e.g., as urged by ejector spring 21) to the cartridge to cause the spent cartridge casing to pivot about the notch in the extractor 300 and eject from the firearm 10. The ejector 19 may be offset from the center of mass of the cartridge casing to cause the casing to rotate towards the firearm ejection port (e.g., ejection port 17 in FIGS. 1-2). The extractor 300 may further include an extractor spring 303 configured to impart a force on the extractor body 300 opposite the end of the extractor that engages the cartridge casing (e.g., a second end as described hereafter). Such a force may, due to the pivotal engagement between the extractor 300 and the bolt 22, urge the first end of the extractor 300 into engagement (e.g., radially inward) with the cartridge casing when the bolt 22 is in the forward position and facilitate hooking and ejecting the cartridge casing as the bolt 22 moves to a rearward position (e.g., once the spent cartridge casing has cleared the barrel or barrel extension).

FIG. 4 illustrates a bolt carrier 200 of a bolt carrier group (20 in FIG. 2) that engages the bolt 22. The bolt carrier 200 and the components of the bolt carrier group are instrumental in the autoloading (e.g., semi-automatic and/or fully-automatic loading) process of firearms described herein. As described above, the gas delivery system 32 forces the bolt carrier group 20 rearward through actuation of the gas delivery system on the bolt carrier 200 through a gas key 232 attached to the bolt carrier, such as with the illustrated fasteners 233. The gas acting through the gas key 232 drives the bolt carrier 200 and bolt carrier group away from the barrel of the firearm along arrow 205. Any other known mechanism for converting the energy of the round into cycling energy for driving a bolt carrier to load another round into the chamber may be used without departing from the scope of the present disclosure. The bolt carrier 200 is biased against this driving force by the buffer spring, which drives the bolt carrier back towards the muzzle during the second half of the cycling action. FIG. 5 illustrates a cut-away view of a bolt carrier 200 within the upper receiver 14 and a buffer spring 235 that biases the bolt carrier 200 toward the barrel, opposite the forces of the gas delivery system. The buffer spring is received within a buffer tube that extends into the stock 16 of the firearm.

Following the firing action by the firearm, in an example embodiment using direct gas impingement autoloading, the gases from barrel gas ports in the barrel flow back towards the action and through the gas delivery to the gas key 232 and act upon the bolt carrier group, driving the bolt carrier 200 and rest of the bolt carrier group toward the stock 16 end of the firearm, against the bias of the buffer spring 235. This action, as described above, causes the firearm to eject the spent casing and chamber a new round from the magazine. For the reloading action to occur, the buffer system must function properly by returning the bolt carrier group to the firing position where the bolt lugs interface with the locking lugs defined by the barrel as shown in FIG. 2 (note that FIG. 2 shows the bolt retracted towards the butt end of the firearm and the breech open). The operability of the buffer system is controlled by two primary factors—the buffer spring and the buffer weight. The buffer weight supplements the weight of the bolt carrier group, and the greater the weight, the more force is required to move the buffer weight from the firing position and the more inertia the assembly has. The buffer spring 235 resists movement of the buffer weight and bolt carrier group toward the stock such that a stiffer spring rate requires more force to drive the bolt carrier group rearward toward the stock. Generally, the heavier the buffer weight, the smoother the action of the buffer system and the slower the firearm cycles due to the inertia of the weight that must be moved. A heavier buffer weight also results in a lower maximum velocity of the bolt carrier group during cycling. However, a buffer weight that is too heavy will not move sufficiently to allow the ejector to properly eject the spent cartridge and the new cartridge to be chambered, which may cause the firearm to jam or otherwise fail to cycle. Similarly, a higher spring rate of a buffer spring can cause faster cycling of the bolt carrier group, but too high of a spring rate may cause the bolt carrier group to cycle faster than a spent cartridge can be ejected and/or faster than a new round can be chambered and too stiff of a spring may also cause the firearm to jam or otherwise fail to cycle. Thus, the buffer system balances weight and spring rate based upon the type of cartridge being fired by the firearm.

Conventionally, a buffer weight may be used separate from the bolt carrier. The buffer weight may extend at least partially into the buffer spring behind the bolt carrier group, while the buffer spring presses against a flange of the buffer weight while the buffer weight loosely rests against the bolt carrier group. Embodiments described herein employ a buffer weight integral with the bolt carrier in addition to or instead of a separate buffer weight. In some embodiments, the firearm may exclude the conventional, separate buffer behind the bolt carrier to shorten the overall length of the firearm and/or buttstock. The lack of a conventional, separate buffer behind the bolt carrier may also facilitate a shorter buffer tube and/or foldable or otherwise collapsible buttstock.

Referring back to FIG. 4, the bolt carrier 200 includes a flange 202 and a buffer weight housing 204 within which the buffer weights are held. The depicted flange 202 and buffer weight housing 204 are integral portions of the structure of the bolt carrier 200. The bolt carrier 200 of an example embodiment includes a hardened exterior surface for durability. The aft section of the bolt carrier of an example embodiment is machined to form the buffer weight housing 204 with a narrower diameter, leaving the flange 202 against which the buffer spring presses. This machining can remove the surface hardening of the buffer weight housing 204 of the bolt carrier 200. This removal of the surface hardening in the area in which the buffer spring acts and the buffer weights move reduces the likelihood of crack development in the bolt carrier.

FIG. 5 illustrates the bolt carrier 200 of embodiments described herein in a cutaway view of an upper receiver 214. As shown, the bolt carrier 200 includes buffer weight housing 204 and buffer spring 235 encircles the buffer weight housing and contacts flange 202. The buffer weight housing 204 portion of the bolt carrier 200 includes a reduced diameter along at least a portion of its length, from the flange 202 aft. This reduced diameter enables the buffer weight housing 204 of the bolt carrier 200 to be received into the buffer spring 235 as shown in FIG. 5. This configuration may further enable a conventional buffer spring to be employed in example embodiments. For example, in some embodiments, the reduced diameter section may be narrower than the interior diameter of a standard buffer spring. FIG. 6 illustrates the bolt carrier 200 from a different view including the buffer weight housing 204 and flange 202. Also visible in FIG. 6 is a bumper element 206, which can be, for example, urethane, high-density polyethylene, rubber, or other material that can provide some degree of dampening in the event that the bolt carrier 200 is pressed into the buffer tube with sufficient force as to bottom-out the bumper element 206 at an end of the buffer tube. The bumper element 206 may be attached to the bolt carrier via any attachment means, including press fitting, welding, adhesive, screws, pins, crimping, threading, or the like. In some embodiments, the bumper element 206 may retain the aft end of the buffer weight as described herein.

The bolt carrier 200 of an example embodiment defines a cavity extending along a longitudinal axis as illustrated in FIG. 6. The longitudinal axis of the bolt carrier is the axis along which the weights within the bolt cavity move during a firing action of the firearm, which corresponds to the axis of movement of the bolt carrier during cycling. The cavity of the embodiment of FIG. 6 is defined by the buffer weight housing.

FIG. 7 illustrates a top view of an upper receiver 214 cutaway view with a section view of a side of the upper receiver 214 taken along section line A-A of the top view. The illustrated embodiment of FIG. 7 includes the buffer system of example embodiments in which the buffer weight is within cavity within the buffer weight housing 204 of the bolt carrier 200. The buffer spring 235 is illustrated as received within buffer tube 250 and engaged with flange 202 about the buffer weight housing 204. In some embodiments, a buttstock may be mounted on the buffer tube, such as is shown in FIGS. 1-2. Within the buffer weight housing 204 of the bolt carrier is a buffer weight 224 which is able to slide within the buffer weight housing along an axis parallel to the direction of travel of the bolt carrier 200. The buffer weight 224 is biased towards and optionally against the bumper element 206 by a spring 212, with the spring 212 disposed between the buffer weight 224 and a forward bumper element 216. During operation, the spring 212 may be configured to smooth the unlocking action, the rearward stroke of cycling, and/or the locking of the bolt at the end of the cycling operation by absorbing and smoothing the transfer of force between the body of the bolt carrier (e.g., as applied through the interior step 218 and bumper element 216) and the buffer weight 224. In some embodiments, the spring 212 may not contact or may rest neutrally against (e.g., applying little to no bias force) the weight 224 when the weight is not pressing against the spring during cycling. In some embodiments, the spring may maintain at least some bias force against the weight 224 at all times.

As depicted in FIG. 7, the forward end of the buffer weight 224 is tapered to a reduced diameter at 222. This taper provides clearance for the hammer 227 to fall while positioning the buffer weight 224 as forward as possible within the bolt carrier. With the buffer weight 224 extending forward as much as possible while still leaving space for the hammer 227 to fall, the buffer weight housing 204 is able to be shortened accordingly. In the depicted embodiment, the tapered portion 222 is connected to the main body of the weight 224 via a narrower, cylindrical portion configured to pass through a central opening in the forward bumper element 216. The portion of the weight 224 extending into and forward of the forward bumper element 216 allows the weight to be heavier while still meeting the space constraints within the bolt carrier 200. The tapered portion 222 illustrated and described is not necessarily critical to functionality in all circumstances; however, the aforementioned advantages render the tapered portion a preferred embodiment for the benefits described.

Because the bolt carrier 200 of some example embodiments described herein may overlap with the buffer spring and may, in some embodiments, be relatively longer than a conventional bolt carrier, disassembly of the upper receiver 214 from the buttstock (including the buffer tube 250) may require removal of the buttstock from the upper receiver 214. According to conventional embodiments of a bolt carrier and separate buffer, the buffer is retained within the buffer tube within the buttstock during disassembly. This enables the upper receiver to be separated from the buttstock through removal of an aft take-down pin 237, and rotation of the upper receiver 214 about the lower receiver relative to the buffer tube 250 and buttstock about forward take-down pin 239. In embodiments, with the buffer spring 235 extending from the buffer tube 250 into the upper receiver 214 to engage the buffer weight housing 204 and bias the bolt carrier against flange 202, disassembly of the upper receiver 214 from the buffer tube 250 and buttstock may require removal of both the forward take-down pin 239 and aft take-down pin 237 and disconnection by first translating the upper receiver and bolt carrier until the spring and bolt carrier separate. This added complexity may be necessitated by the benefits obtained by housing the buffer weights within the bolt carrier 200, and shortening the space needed outside of the upper receiver 214 for the buffer spring 235.

FIG. 8 illustrates the bolt carrier group including the bolt carrier 200 without the upper receiver for ease of understanding. FIG. 8 illustrates a top view including section line B-B, a side view, and a section view as taken along section line B-B. As shown, the bolt carrier 200 includes the buffer weight housing 204 received within the buffer spring 235 that extends into the buffer tube 250. The section view depicts the buffer weight 224 carried within the buffer weight housing, bumper element 206, forward bumper element 216, step 218, and spring 212. As further depicted in FIG. 8, the interior of the bolt carrier, including at least a portion of the buffer weight housing 204, may be open (e.g., along the bottom side of the bolt carrier).

The buffer system illustrated in FIG. 8 is depicted in a position before a firing action commences. When the firing action commences, gas is received into gas key 232, unlocking the bolt and driving the bolt carrier 200 aft from the barrel toward the buffer tube 250 and against the bias of the buffer spring 235 (e.g., compressing the buffer spring). In the depicted embodiment, force from the bolt carrier 200 is applied to the weight 224 via an internal step 218 acting on a forward bumper element 216, which in turn applies force to the spring 212, which acts on the weight 224. As this movement initially starts to occur, the buffer weight 224 reacts by compressing against spring 212 within the buffer weight housing 204. This transfer of the buffer weight within the housing reduces recoil of the firearm by reducing the weight immediately moved responsive to the gas pressure and delays the movement of the buffer weight 224 albeit momentarily. This delay helps to smooth the forces acting within the firearm reducing peaks in acceleration, thereby enabling smoother, more consistent operation of the firearm. After the initial movement of the bolt carrier 200 toward the buffer tube 250, the bolt carrier continues to compress the buffer spring 235. When the compressive force of the bolt carrier 200 matches return force associated with the spring rate of the buffer spring 235, the bolt carrier 200 ceases to move toward the aft end of the firearm and the buffer tube 250, and the buffer spring 235 begins to drive the bolt carrier back towards the muzzle and towards the position shown in FIG. 8. During at least a portion of the initial part of the return stroke towards the muzzle end of the firearm, the bumper element 206 may apply a force to the weight 224 to accelerate the weight. The buffer spring 235 continues to drive the bolt carrier 200 toward the muzzle end and the barrel until the bolt engages and locks with the barrel as depicted in FIG. 2.

The depicted weight 224 may assume a variety of shapes, including the shape shown in FIG. 8 with a cylindrical main body and a narrower cylindrical shape with a conical, tapered nose extending through a center bore in the forward bumper element 216 and step 218. In some embodiments, the front, narrower cylinder may be used to adjust the size of the buffer weight without modifying the bolt carrier by adjusting the length of the narrower cylindrical portion. In some embodiments, the depicted bolt carrier 200 may be a standard bolt carrier length for the respective weapons platform (e.g., no length may need to be added to accommodate the weight). For example, a "standard" length may refer to the length called for in technical documentation associated with the particular firearm package, such as a Technical Data Package ("TDP") associated with the original firearm specification, such as, for example, 6.672 inches. In some embodiments, the depicted bolt carrier 200 may have a length other than standard, such as, for example, 6.700 inches from the muzzle end adjacent the bolt to the rearmost end of the bumper element 206.

In some embodiments lacking a separate buffer weight outside the bolt carrier, such as the embodiment of FIGS. 5-8, the buffer tube may be shortened relative to a stock buffer tube. For example, a standard AR-15 may define 14.22 inches from the center of the front takedown pin opening to the rear end of the buffer tube, with a distance from the rear of the lower receiver to the rear end of the buffer tube measuring 6.72 inches. In various embodiments of the present disclosure, such as the embodiment of the AR-15 shown in FIG. 7, the distance from the center of the front takedown pin opening 239 to the rear end of the buffer tube 250 may measure 11.13 inches, and the distance from the rear of the lower receiver (e.g., the rearmost dashed-line portion of FIG. 7 below the buffer tube 250 and above the grip) to the rear end of the buffer tube measuring 3.63 inches.

The movement of the buffer weight 224 within the buffer weight housing 204 provides a dampening effect of the movement of the bolt carrier 200 in response to the firing action, slowing cycling slightly and improving the cycling reliability of the firearm. For example, in some embodiments, as the bolt slides past the lugs of the barrel extension, the bolt may contact the end of the barrel. When the bolt contacts the end of the barrel, the bolt carrier may continue moving forward, causing the bolt to rotate and lock behind the lugs. During this locking action, the spring 212 may slow and smooth the movement of the weight 224 while delivering the inertia of the weight to the locking action, mitigating any bounce effect that may result from the lugs of the bolt carrier slamming against the barrel extension. This dampening effect also mitigates recoil and improves the stability of the firearm during the firing action. Improving stability allows the firearm to remain more easily aligned with a target thereby improving accuracy of subsequent or sequential firing actions. Moreover, in embodiments having only a buffer weight within the bolt carrier, the length of the buffer tube may be shortened relative to a bolt carrier with a separate buffer weight due to no longer needing to accommodate a separate buffer weight between the buffer spring and the bolt carrier. In some embodiments, the buffer weight 224 may be wholly disposed within the bolt carrier 200 at all times during operation. In some embodiments, the buffer weight 224 may be wholly disposed in front of an aft end of the bolt carrier 200 at all times during operation.

As described above, different rounds produce different forces resulting from a firing action. The buffer system described herein can be tuned based on the round to be fired. The buffer weight 224 can be exchanged with a buffer weight of a different weight and/or density. For example, a denser and/or heavier buffer weight can be used for relatively larger rounds with a larger explosive force. Further, the buffer spring 235 and the spring 212 can be replaced with springs of different spring rates based upon the rounds to be fired. Various embodiments of the buffer weight(s) disclosed herein may be made of, for example, steel, carbide, tungsten, zinc, or aluminum. In some embodiments, a separate external buffer (e.g., buffer 424 shown in FIGS. 10-16) may be used in addition to a buffer within the bolt carrier in circumstances where greater reciprocating weight is desired for the firearm. In some embodiments, the separate external buffer may be omitted to shorten the overall length of the firearm. In some embodiments, firearm platforms using larger rounds may utilize both an internal and an external buffer. In some embodiments, firearm platforms using smaller rounds may utilize only an internal buffer within the bolt carrier.

Embodiments provided herein include various mechanisms through which bolt carrier group movement responsive to a firing action is smoothed with a sliding weight within the bolt carrier. FIG. 9 illustrates a bolt carrier group of a firearm including a bolt carrier 400 and gas key 432 similar to those described with respect to FIG. 2. Also shown is a buffer 424 within the buffer tube 450, where the buffer is separate from the bolt carrier 400. Not shown is the buffer spring that encircles the buffer and presses the buffer into contact with the bolt carrier, similar to buffer spring 235 described above. The buffer 424 includes therein buffer weights 426 with bumpers separating the individual weights.

The mechanism of example embodiments described herein provide sliding weight within a cavity of the bolt carrier similar to that described above with respect to FIG. 8. The sliding weight within the bolt carrier of the preceding embodiments and/or the following further embodiments can be used together with a conventional buffer system as illustrated in the following figures. In the depicted embodiments, the two sets of weights (e.g., one within the bolt carrier and one aft of the bolt carrier) may operate together to smooth cycling of the firearm. This may be particularly useful, for example, with larger rounds, such as may be used with AR-10 platform rifles.

FIG. 10 illustrates an example embodiment in which an embodiment of a sliding weight is provided within a cavity 402 of the bolt carrier 400 in the form of two balls 460. The balls 460 of the illustrated embodiment are disposed between resilient spacers 464. The resilient spacers 464 which may be of a polymer material to reduce wear on the carrier and within the bore of the bolt carrier 400. The depicted resilient spacers 464 may include multiple discrete components on either side of the weight(s) (e.g., spacers 464 configured to engage the weight(s)). In some embodiments, the weight(s) 480 may directly contact an interior surface of the bolt carrier 400. In some embodiments, the resilient spacers 464 are loosely disposed between adjacent balls and/or at the fore and/or aft end of the ball assembly. The weights embodied by balls 460 of the illustrated embodiment are configured to allow smooth movement of the weight(s) as it moves within the bolt carrier 400 similar to the weights described above with respect to FIGS. 4-8. The weight(s) are biased toward the barrel of the firearm with spring 468 and held against a forward stop 466, such as a pin within the bore of the bolt carrier. The spacers 464, which may or may not be present depending upon the configuration of the weight(s) may be moved by the weight(s) within the bolt carrier 400 as the weights move during a firing action. In some embodiments, the spring 468 operates under compression from the aft side of the balls 460 in an inverse manner to the spring 212 acting under compression in the embodiments of FIGS. 7-8 from the muzzle end of the weight. The spring location may be reversed in the various embodiments herein such that the spring(s) are configured to apply a force from the opposite side of the buffer weight to the direction depicted. An aft stop 472 is also provided to retain the weights within the bolt carrier, with the stops engaging the spacers 464 of the illustrated embodiment, during the firing action as described further below. The spring 468 may be held in place with a pin 470 as illustrated in the figures or may be attached via any other means, such as those described herein for attachment, including press fit. The embodiments of FIGS. 10-16 depict both a buffer weight inside the bolt carrier and a separate buffer external of the bolt carrier. These embodiments, similar to those discussed above, may include both the internal and external weights or either set of weights independently. In some embodiments, the depicted bolt carrier 400 may be a standard bolt carrier length for the respective weapons platform (e.g., no length may need to be added to accommodate the weight). For example, a "standard" length may refer to the length called for in technical documentation associated with the particular firearm package, such as a Technical Data Package ("TDP") associated with the original firearm specification, such as, for example, 6.672 inches.

FIG. 11 illustrates a second embodiment of the sliding weight mechanism described herein. The embodiment of FIG. 11 includes many of the same components as described with respect to FIG. 10, such as the resilient spacers 464, forward stop 466, aft stop 472, and spring 468. However, the weight within the bolt carrier 400 is a pill-shaped weight 480. FIG. 12 illustrates another embodiment of the sliding weight mechanism described herein. The embodiment of FIG. 12 uses the spacers 464 with two balls 460 as weights; however, the forward stop 476 is a step within the bore of the bolt carrier 400. Further, the aft stop is a threaded plug 482 within which rests the spring 468 biasing the weights (balls 460) toward the forward stop 476 where the spacers 464 engage the forward stop. FIG. 13 illustrates a similar embodiment where a pill-shaped weight 480 is biased toward the forward stop 476, with the spacers 464 engaging the forward stop. The forward stop 476 being the step within the bore of the bolt carrier 400, and the aft stop being the threaded plug 482 within which rests the spring 468. In each of the embodiments of FIGS. 10-13, the sliding weight function is the same and any of the foregoing differences between embodiments may be combined and/or substituted for each other. The weight adds some mass to the bolt carrier resulting in more reciprocating mass, which makes operation of the firearm smoother and slower, causing a greater damping effect with a larger mass. The shape of the sliding weight, depicted as round balls and a pill-shape, is not limited to the illustrated embodiments, and can be any viable shape that produces the desired function as described below. In some embodiments, a slightly rounded or fully rounded shape may facilitate less wear and easier sliding of the weight within the bolt carrier.

In operation, the sliding weights within the bolt carrier function to smooth the action of the bolt carrier group in ejecting a spent casing and chambering a new round after a firing action. FIG. 14 illustrates a first position 510 where the firearm is loaded and awaiting a trigger pull (e.g., the weight is in a neutral position) where the weight is biased forward driving a spacer 464 against the forward stop 476 by spring 468. In the first position 510, the spacer 464 with the weight is biased forward such that a gap exists at 490 between the spacer 464 and the aft stop of the threaded plug 482. Upon a trigger pull and firing action of the firearm, the bolt carrier 400 is driven away from the barrel as shown at second position 520, where the buffer is driven into the buffer tube 450. As the bolt carrier is driven toward the rear of the firearm, the spacer 464 and weight are held against the forward stop 476, such that a gap remains at 490 with no gap at 492.

As the bolt carrier 400 and buffer 424 compress the buffer spring (not shown) within the buffer tube, the bolt carrier 400 and buffer 424 are slowed until they stop moving aft, at which point the buffer spring force overcomes the rearward movement of the bolt carrier. FIG. 15 depicts this position 530 where the buffer stops against the buffer tube of the receiver extension or otherwise at the rearmost point of its travel. This forces the weight aft, against the spring 468. This closes the gap at 490 and forms a gap at 492. The distance that the weight travels within the bolt carrier 400 causes a momentary delay in the position of the bolt carrier until it is overcome by the biasing of the buffer spring, forcing the bolt carrier 400 forward. The spacers 464 may move independently of the weight such that the spacers may move with the movement of the weight, a portion of the movement of the weight, or not at all with respect to the weight depending upon the relative position. FIG. 15 illustrates the bolt carrier moving forward at position 540 with the spacer 464 and weight still pressed against the bias of spring 468 and in contact with the aft stop of the threaded plug 482. The bolt carrier 400 stops moving forward when the lugs of the bolt carrier come into contact with the barrel extension. In some embodiments, the spring 468 may rest neutrally (e.g., applying little to no bias force) with respect to the weight(s) when the weight is not pressing against the spring during cycling. In some embodiments, the spring may maintain at least some bias force against the weight(s) at all times.

As shown in FIG. 16, the spacer 464 and weight are forced forward by their momentum to the forward stop 476. The distance that the weight travels within the bolt carrier from the aft stop to the forward stop causes a secondary impact of the spacer 464 against the forward stop 476, which is transmitted to the bolt carrier 400 against the barrel extension, mitigating any bounce effect that may result from the lugs of the bolt carrier slamming against the barrel extension. Thus, the action is smoothed and peaks in acceleration of the firearm due to impacts are lessened. This smoothing of the action enables the firearm to remain properly aligned with a target by reducing sharp movements of higher acceleration.

The embodiments described herein may also be scalable to accommodate at least the aforementioned applications such as with respect to different size and configurations of firearms and different types of cartridges. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

That which is claimed:

1. A bolt carrier assembly for a firearm comprising:
a bolt carrier body defining a cavity extending along a longitudinal axis of the bolt carrier;
at least one weight disposed within the cavity and movable relative to the bolt carrier body;
a forward stop at a forward end of the cavity; and
an aft stop at an aft end of the cavity; and
a spring, wherein the spring is configured to bias the at least one weight along the longitudinal axis into contact with one of the forward stop or the aft stop.

2. The bolt carrier assembly of claim 1, wherein the at least one weight is configured to be driven against the spring bias in response to a firing action of the firearm.

3. The bolt carrier of claim 1, wherein the at least one weight is only spring biased in one direction along the longitudinal axis toward the one of the forward stop or the aft stop.

4. The bolt carrier assembly of claim 1, wherein the aft stop comprises a threaded plug received within a bore of the bolt carrier body.

5. The bolt carrier assembly of claim 4, wherein the spring is disposed between the threaded plug and the at least one weight and biases the at least one weight into contact with the forward stop.

6. The bolt carrier assembly of claim 1, further comprising at least one spacer disposed between the weight and at least one of the forward stop and the aft stop.

7. The bolt carrier assembly of claim 6, wherein the one or more weights are at least one of one of a capsule shaped weight or a ball shaped weight within a corresponding cavity of the carrier, wherein the at least one spacer comprises a first spacer disposed between the one or more weights and the forward stop and a second spacer disposed between the one or more weights and the aft stop.

8. The bolt carrier assembly of claim 1, wherein the forward stop comprises at least one of a step or a pin within a bore of the bolt carrier body.

9. The bolt carrier assembly of claim 1, wherein the at least one weight is disposed entirely forward of an aft-most side of the bolt carrier body.

10. The bolt carrier assembly of claim 9, wherein a length of the bolt carrier body corresponds to a Technical Data Package (TDP) length for the firearm.

11. The bolt carrier assembly of claim 1, wherein a portion of the at least one weight extends forward past the forward stop.

12. The bolt carrier assembly of claim 1, wherein the at least one weight disposed within the cavity comprises a tapered forward end.

13. The bolt carrier assembly of claim 12, wherein the tapered forward end of the at least one weight is configured to provide clearance for rotation of a hammer of the firearm that would contact a forward end of the at least one weight if not for the tapered forward end.

14. A firearm comprising:
a barrel assembly comprising a barrel or a barrel extension defining one or more locking lugs;
an upper receiver attached to the barrel assembly;

a bolt carrier within the upper receiver, wherein the bolt carrier defines a cavity therein extending along a longitudinal axis of the bolt carrier, the bolt carrier comprising a bolt engaging the one or more locking lugs of the barrel assembly;

at least one weight disposed within the cavity;

a forward stop at a forward end of the cavity;

an aft stop at an aft end of the cavity; and a spring, wherein the spring is configured to bias the at least one weight along the longitudinal axis into contact with one of the forward stop or the aft stop.

15. The firearm of claim 14, wherein the at least one weight is only spring biased in one direction along the longitudinal axis toward the one of the forward stop or the aft stop.

16. The firearm of claim 14, wherein in response to a firing action of the firearm, the bolt carrier is configured to be driven away from the barrel assembly, and the at least one weight disposed within the cavity is configured to be driven along the longitudinal axis against the spring bias in response to the firing action of the firearm.

17. The firearm of claim 14, wherein the spring is disposed between the forward stop and the at least one weight, wherein the spring biases the at least one weight along the longitudinal axis toward the aft stop.

18. The firearm of claim 14, wherein the spring is disposed between the aft stop and the at least one weight, wherein the spring biases the at least one weight along the longitudinal axis toward the forward stop.

19. The firearm of claim 14, further comprising at least one spacer disposed between the weight and at least one of the forward stop and the aft stop.

20. The firearm of claim 14, further comprising a second weight disposed outside the bolt carrier within a buffer tube of the firearm.

21. The firearm of claim 14, wherein the at least one weight consists of a single weight disposed within the cavity of the firearm.

22. The firearm of claim 14, wherein the bolt carrier further defines a flange configured to engage a buffer spring, wherein the buffer spring is disposed in a buffer tube of the firearm.

23. A weight for a bolt carrier assembly of a firearm, the weight defining:

a main body defining a proximal end, a distal end, and a first diameter perpendicular to an axis extending between the proximal end and the distal end, the first diameter being configured such that the weight is configured to fit within a bolt carrier;

a second portion extending from the proximal end of the main body, the second portion defining a second diameter that is less than the first diameter, wherein the second portion is disposed, during at least a portion of a firing cycle for the firearm, proximate to a hammer of the firearm, wherein second diameter of the second portion provides a clearance for the hammer of the firearm to operate.

24. The weight of claim 23, wherein the second portion of the weight defines a tapered tip.

25. The bolt carrier assembly of claim 1, wherein the spring configured to bias the at least one weight along the longitudinal axis into contact with one of the forward stop or the aft stop is the only spring providing bias to the at least one weight.

* * * * *